US005226189A

United States Patent [19]

Blutstein

[11] Patent Number: 5,226,189

[45] **Date of Patent: * Jul. 13, 1993**

[54] HUNTING HOOD WITH NYLON NET FACE COVER

[75] Inventor: Morton Blutstein, Milwaukee, Wis.

[73] Assignee: Reliable Knitting Works, Milwaukee, Wis.

[ * ] Notice: The portion of the term of this patent subsequent to Sep. 15, 2009 has been disclaimed.

[21] Appl. No.: 897,318

[22] Filed: Jun. 11, 1992

Related U.S. Application Data

[63] Continuation of Ser. No. 718,545, Jun. 20, 1991, Pat. No. 5,146,622.

[51] Int. Cl.[5] ..... A42B 3/18

[52] U.S. Cl. ..... 2/4; 2/202

[58] Field of Search ..... 2/2, 4, 173, 202, 205, 2/206, 209.5, 410, 424

[56] References Cited

U.S. PATENT DOCUMENTS

| | | | |
|---|---|---|---|
| 640,412 | 1/1900 | Petersen | 2/4 |
| 2,344,811 | 3/1944 | Gill | 2/2 |
| 2,362,597 | 11/1944 | Vince | 2/173 |
| 2,365,656 | 12/1944 | Lamsa | 2/4 |
| 2,869,132 | 1/1959 | Drummond | 2/4 |
| 2,998,611 | 9/1961 | Scheussler | 2/202 |
| 3,582,989 | 6/1971 | Fassbender | 2/4 |
| 3,660,850 | 5/1972 | Garbisch | 2/2 |
| 4,395,781 | 8/1983 | Myers | 2/4 |
| 4,397,044 | 8/1983 | Trepanier | 2/4 |
| 4,422,184 | 12/1983 | Myers | 2/4 |
| 4,716,594 | 1/1988 | Shannon | 2/4 |
| 5,146,622 | 9/1992 | Blutstein | 2/202 |

FOREIGN PATENT DOCUMENTS

| | | | |
|---|---|---|---|
| 159730 | 4/1940 | Fed. Rep. of Germany | 2/205 |
| 102213 | 8/1941 | Fed. Rep. of Germany | 2/4 |
| 183270 | 9/1955 | Fed. Rep. of Germany | 2/4 |
| 60439 | of 0000 | Switzerland | 2/4 |
| 625684 | 9/1978 | U.S.S.R. | 2/4 |
| 125800 | 5/1919 | United Kingdom | 2/4 |
| 684962 | 12/1952 | United Kingdom | 2/206 |

*Primary Examiner*—Clifford D. Crowder
*Assistant Examiner*—Diana L. Biefeld
*Attorney, Agent, or Firm*—Michael, Best & Friedrich

[57] ABSTRACT

A head covering comprising a hat constructed and arranged to cover the entire head of a wearer except for an opening which exposes substantially the wearer's entire face. A face covering extends across the opening and is attached to the head covering along the upper and side edges thereof, the lower edge of the face covering being disconnected from the head covering to provide a gap therebetween. The face covering is formed of a mesh-like material which permits wearer visibility and defines horizontal and vertical arcs which are longer than the corresponding arcs formed by the face opening so that the face covering is positioned in spaced relation from the wearer's face.

2 Claims, 1 Drawing Sheet

HUNTING HOOD WITH NYLON NET FACE COVER

This is a continuation of co-pending application Ser. No. 718,545 filed Jun. 20, 1991 and entitled "HUNTING HOOD WITH NYLON NET FACE COVER", now U.S. Pat. No. 5,146,622.

BACKGROUND OF THE INVENTION

This invention relates to camouflage clothing and more particularly to a camouflage head covering intended for use by hunters.

Hunters, and particularly those such as bow hunters, who must closely approach game animals and birds, often wear camouflage clothing including head and face coverings to avoid detection. One type of camouflage head covering comprises a hood which covers the wearer's head and face except for an eye opening covered by a mesh or netting. Such hoods are not wholly satisfactory because the hood tends to remain in position when the wearer's head is turned from side-to-side. This severely restricts side visibility.

Another type of camouflaged head covering consists of a knit pullover which covers the head, face and neck except for eye holes. While permitting good visibility regardless of head position, pullovers tend to be uncomfortable when worn for any extended period of time. Camouflage hoods and pullovers also restrict the use of game calls.

SUMMARY OF THE INVENTION

It is an object of the invention to provide a new and improved camouflage head covering.

Another object of the invention is to provide a camouflage head covering which permits a full range of head movements without loss of visibility.

A further object of the invention is to provide camouflage head covering which is comfortable to wear for extended periods.

Still another object of the invention is to provide camouflage head covering which permits the use of game calls.

These and other objects and advantages of the present invention will become more apparent from the detailed description thereof taken with the accompanying drawings.

In general terms, the invention comprises a head covering comprising a hat constructed and arranged to cover the entire head of a wearer except for an opening which exposes substantially the wearer's entire face, a face covering extending across the opening and being attached to the head covering along the upper and side edges thereof, the lower edge of the face covering being disconnected from the head covering to provide a gap therebetween, the face covering being formed of a mesh-like material which permits the wearer visibility and defines horizontal and vertical arcs which are longer than the corresponding arcs formed by the face opening so that the face covering is positioned in spaced relation from the wearer's face.

DETAILED DESCRIPTION OF THE PREFERRED EMBODIMENT

Figure 2:
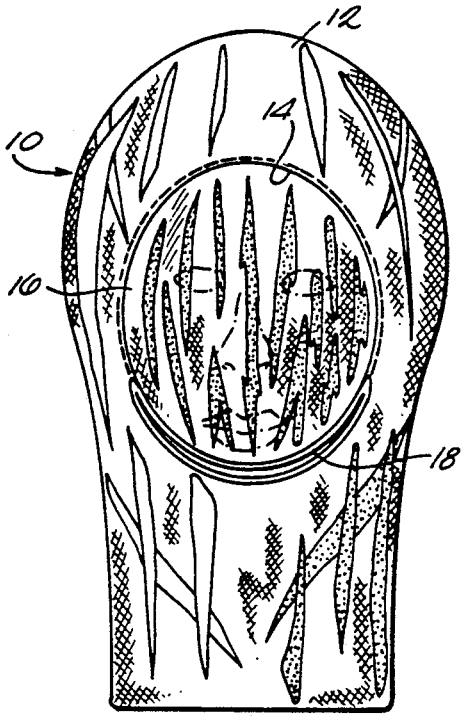
FIG. 2 is a front view thereof.
Figure 1:
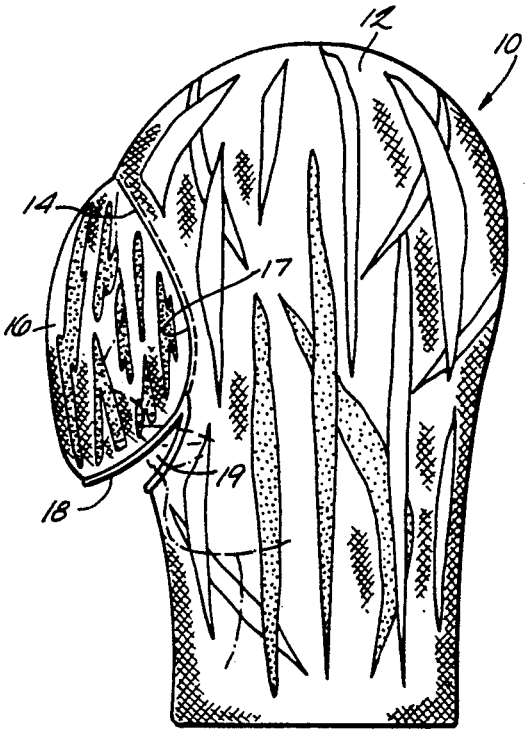
FIG. 1 is a side elevational view of the camouflage head covering in accordance with the preferred embodiment of the invention.
Figure 3:
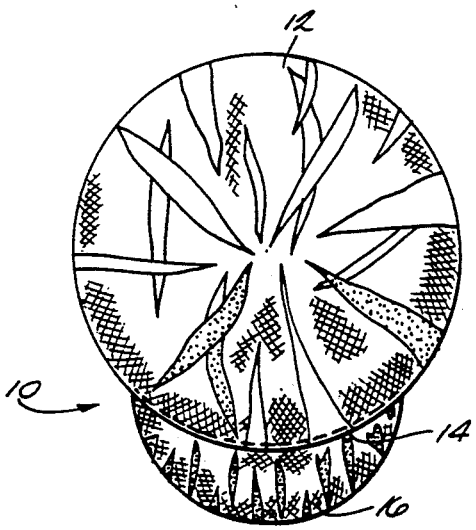
FIG. 3 is a top view thereof.

The camouflage 10 head covering, according to the preferred embodiment of the invention, comprises a knit hat 12 which preferably covers the entire head and neck of the wearer except for an opening 14 which exposes the wearer's face. The hat is preferably knit from any suitable material such as wool or acrylic yarn so that it will stretch to conform to the wearer's head. The hat may be knit from multi-colored yarn or dyed to provide the desired camouflage pattern.

Attached to the upper and side edges of the opening 14 is a face covering which may comprise a net or mesh-like material formed of relatively thin threads with spacing of about 0.5–1.0 mm. This provides good visibility to the wearer and yet permits a camouflage pattern to be applied to conform to that of the hat 12. As seen in the drawings, the length of the arcs formed by the face cover 16 in both the horizontal and vertical directions are substantially greater than that of the face opening 14. In addition, the threads which form the face covering 14 are preferably relatively stiff so that the face covering retains a substantially semi-oval shape and thereby remains spaced from the wearer's face except for the edge portion which is attached to the head covering. As a result, the head covering is substantially more comfortable than a face covering which contacts the face. The net or mesh which forms the face covering 14 may be formed of any suitable material, such as nylon.

The edge 17 of the face covering 16 is attached to the edge of the opening 14 in any suitable manner, such as by sewing, except for the lower edge 18 of the face covering 16 which is unattached. This provides a gap 19 between the hat 12 and the face covering 16 which permits the wearer to take refreshment or use game calls.

The shape of the face covering increases wearer comfort because there is little or no engagement with the face itself. However, because the hat 12 closely engages the head, the opening 14 in the face covering 16 closely follows head movement so that there is no loss of visibility when the head is moved.

While only a single embodiment of the invention has been illustrated and described, it is not intended to be limited thereby, but only by the scope of the appended claims.

I claim:

1. A head covering comprising:

a hat formed of a stretchable knit material, the hat including a face opening having a periphery, said hat being constructed and arranged to cover the entire head of a wearer except for the wearer's face which is substantially exposed by said face opening, said hat being stretchable to conform to the wearer's head and to closely engage the wearer's head so that the face opening closely follows head movement, and a face covering extending across said face opening, said face covering including a peripheral edge having an upper edge portion and side edge portions, said upper and side edge portions being attached to said periphery of said face opening, said face covering being formed of a mesh material which permits the wearer visibility, and said face covering being constructed and arranged to be positioned in spaced relation from the wearer's face.

2. A head covering as set forth in claim 1 wherein said face covering is formed of a nylon mesh.

* * * * *